United States Patent [19]

Mroz

[11] Patent Number: 4,708,096

[45] Date of Patent: Nov. 24, 1987

[54] INTERNAL COMBUSTION ENGINE

[76] Inventor: Joseph Mroz, 2572 Montgomery Street, Montreal, Quebec, Canada, H2K 2S4

[21] Appl. No.: 832,446

[22] Filed: Feb. 24, 1986

[51] Int. Cl.[4] ..... F02B 75/04

[52] U.S. Cl. ..... 123/48 A; 123/78 A; 123/54 R

[58] Field of Search ..... 123/54, 48 R, 48 A, 123/78 R, 78 A, 48 D, 78 D

[56] References Cited

U.S. PATENT DOCUMENTS

| | | | |
|---|---|---|---|
| 1,464,164 | 8/1923 | Alarie | 123/78 A |
| 1,848,597 | 3/1932 | Arnold | 123/78 A |
| 3,312,206 | 4/1967 | Radovic | 123/48 A |
| 3,741,175 | 6/1973 | Rouger | 123/48 A |
| 4,169,435 | 10/1979 | Faulconer | 123/78 A |

FOREIGN PATENT DOCUMENTS

| | | | |
|---|---|---|---|
| 111795 | 12/1897 | Fed. Rep. of Germany | 123/54 R |

*Primary Examiner*—Craig R. Feinberg

[57] ABSTRACT

The cylinder head of each power cylinder of this internal combustion engine includes an auxiliary cylinder in communication with the power cylinder. An auxiliary piston is moveable within the auxiliary cylinder in synchronism with the power piston. During the compression stroke of the engine the auxiliary piston is retracted and the auxiliary cylinder becomes filled with the combustible mixture. This mixture is transferred back to the power cylinder as the power piston moves away from its upper dead center position. Thus the time during which the mixture is at maximum compression is increased and therefore the explosion takes place when the crank shaft has already rotated through an appreciable angle from the upper dead center position. Thus the torque exerted by the power piston is considerably increased with respect to the conventional engine. To further increase this torque the axis of the crank shaft is laterally offset from the center line of the power cylinder in a direction to increase said torque.

7 Claims, 6 Drawing Figures

INTERNAL COMBUSTION ENGINE

FIELD OF THE INVENTION

This invention relates to internal combustion engines of the reciprocating type.

BACKGROUND OF THE INVENTION

In engines of the above noted type the maximum combustion gas compression occurs when the piston is in upper dead center position and this pressure decreases immediately upon start of the power stroke of the piston. In the upper dead center position of the piston, the piston crank rod is not only coaxial with cylinder longitudinal axis but is also in alignment with the crank shaft axis. Therefore torque starts to develop only after the crank shaft has rotated to a certain angle with the result that the combustion gases pressure has already decreased. Thus the power output of the engine is limited by this known kinetic arrangement.

OBJECTS OF THE INVENTION

It is the main object of the present invention to considerably increase the power output of an internal combustion engine as compared to a conventional engine of the same compression ratio and same cylinder volume.

Another object of the present invention is, by a minimum of modification, to increase the power output by at least 100% with respect to a conventional piston-type engine of the same size.

SUMMARY OF THE INVENTION

The internal combustion engine of the present invention is provided with the conventional engine block, cylinder head, power piston, crank shaft, crank rod, intake and exhaust valves in the cylinder head and a combustible mixture igniting means. The engine is characterized by the provision of a working chamber extension which communicates with the working chamber and is non-engageable by the power piston. A secondary piston is reciprocable within the chamber extension so as to decrease the volume of the chamber extension during the time the crank shaft moves through a predetermined angle from the upper dead center position of the power piston. During this crank shaft rotation the maximum compression pressure remains preferably substantially constant whereby ignition of the combustible gases can take place at maximum gas compression and at a time where an appreciable torque arm has already developed at the crank shaft. To further increase the effective torque arm, the crank shaft axis is laterally offset from the cylinder longitudinal axis in the direction of torque arm increase.

DETAILED DESCRIPTION OF THE PREFERRED EMBODIMENT

Figures 1, 3:
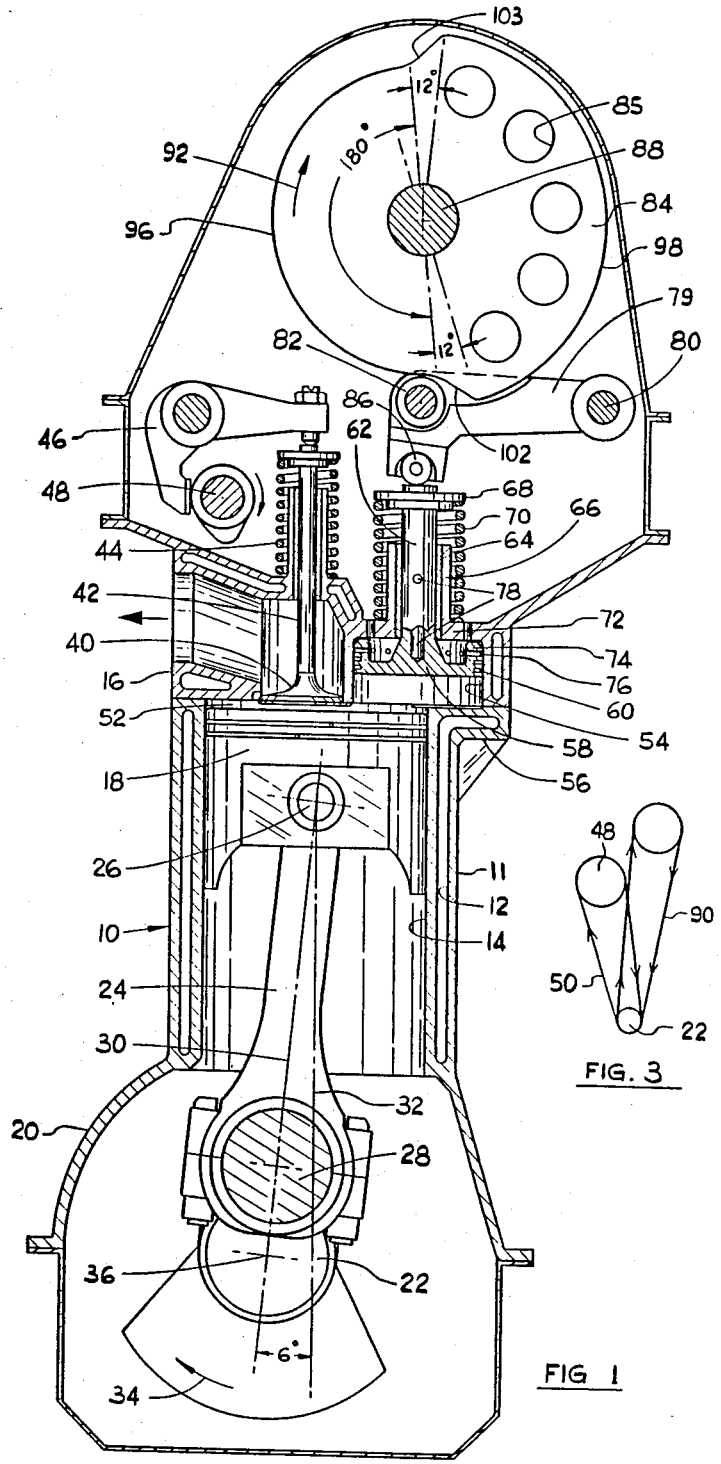
FIG. 1 is a cross-section of one cylinder arrangement of the internal combustion engine of the invention and with the power piston in its upper dead center position.
FIG. 3 shown on the first page of the drawings is a schematic view of the drive for the valve cam shaft and for the secondary piston cam shaft.

The engine has an engine block 10 forming cylinder jackets 11 provided with liquid cooling passages 12 for one or more cylinders 14. One end of each cylinder 14 is closed by a valve head 16. A piston 18 is reciprocably mounted within the cylinder 14. The open end of the cylinder 14 communicates with a crank case 20 in which is journalled a crank shaft 22. A connecting rod 24 pivotally connects the piston 18, by means of a connecting pin 26, to the wrist pin 28 of the crank shaft 20.

One characteristic feature of the present invention resides in the fact that, as shown in FIG. 1, in the upper dead center position of the piston 18 wherein the longitudinal axis 30 of the connecting rod 24 intersects the axis of crank shaft 22, longitudinal axis 30 makes an angle with the longitudinal axis 32 of the cylinder 14. This angle is about 6° and may vary depending on the configuration of the engine. This angle is in a direction with respect to the longitudinal axis 32 so as to increase the torque of the engine. Referring to FIG. 1, considering that the crank shaft moves in a clockwise rotation as by arrow 34, the lateral offset of the crank shaft axis 36 is to the left of cylinder axis 32.

Figures 2, 4:
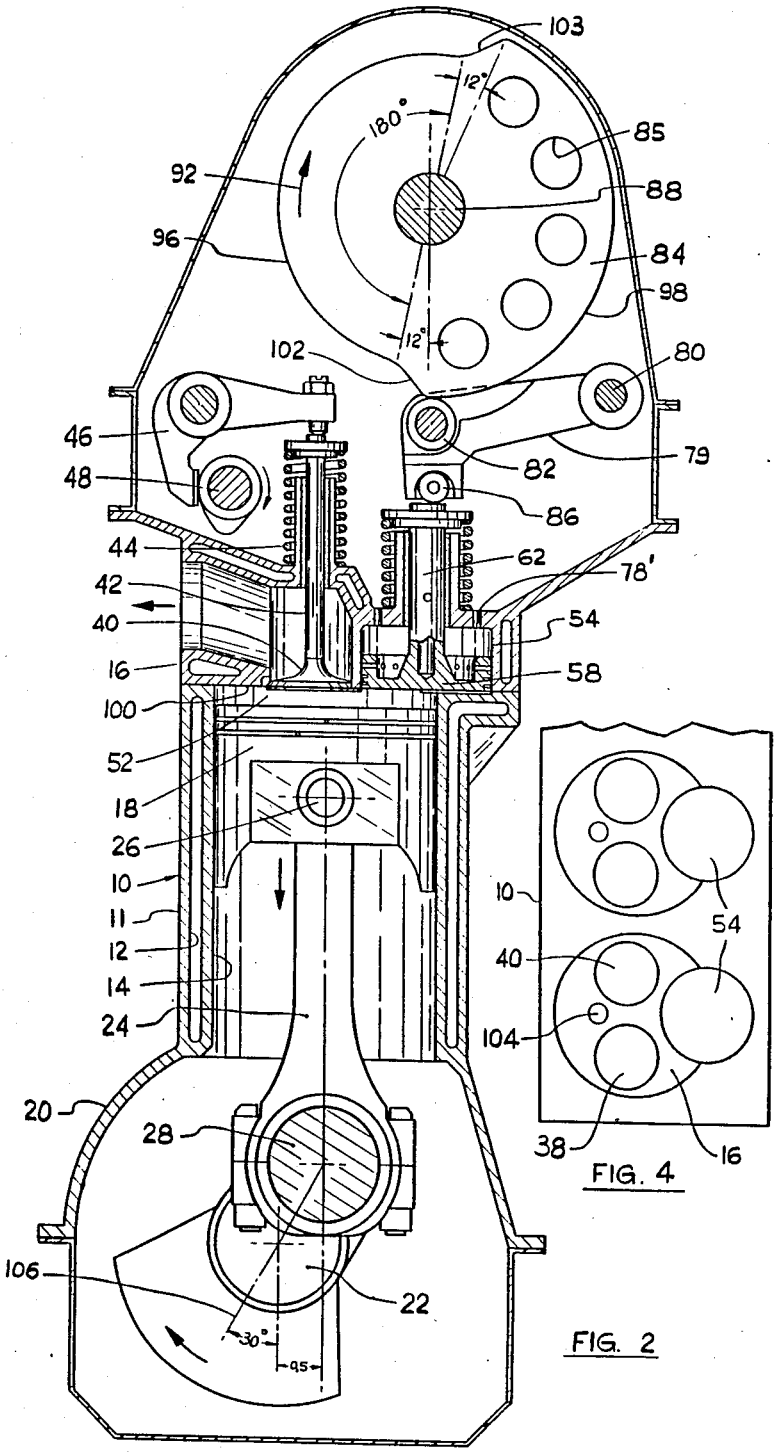
FIG. 2 is a view similar to that of FIG. 1 with the power piston in the position where ignition of the combustible gases takes place.
FIGS. 4, 5 and 6 are schematic top plan views of various arrangements of the cylinder heads.

Cylinder head 16 carries the usual intake and exhaust valves 38 and 40 respectively as schemetically shown in FIG. 4. The exhaust valve 40 is shown in FIG. 1. These two valves have a valve stem 42 and are biased in closing position by a compression coiled spring 44. The valves 38, 40 are operated in synchronism with the crank shaft in conventional manner for a four cycle engine by means of the rocker arm 46, valve cam shaft 48 and drive 50 which may be a chain link and sprocket arrangement between the valve cam shaft 48 and the crank shaft 22, so that the valve cam shaft 48 rotates at half the speed of the crank shaft in conventional manner.

In the upper dead center position of the piston 18 the effective volume of the working chamber 52 formed between the piston 18 and the cylinder head 16 is at a minimum as shown in FIG. 1. In accordance with the main feature of the present invention, this working chamber 52 is in communication with a cylinder extension 54. Cylinder extension 54 has a diameter which is smaller than the diameter of the power cylinder 14. For instance, it is equal to about between 0.4 and 0.25 the diameter of said power cylinder.

To accommodate the cylinder extension 54 as well as the intake and exhaust valves arrangement, the cylinder head may form, on one side, a lateral projection 56 protruding from the side of the engine block 10.

A secondary piston 58 is reciprocable within the cylinder extension 54 and is in sealing contact with its surface by sealing rings 60. Secondary piston 58 has an axial piston rod 62 guided and slideable within a bushing 64 surrounded by a sleeve 66 integral with the cylinder head 16. Washers 68 are secured to the upper end of piston rod 62 and serve as an abutment for a compression coil spring 70 surrounding the piston rod 62 and bearing at its other end against the cylinder head 16. Compression spring 70 biases the secondary piston 58 to a retracted position in which the secondary piston 58 abuts against the closed end 72 of the cylinder extension 54. Secondary piston 58 has a skirt 74 provided with radial passages 76 for lubrication and piston rod 62 has passages 78 for lubrication and for weight reduction.

The axis of the secondary piston 58 and of its piston rod 62 is preferably parallel to the valve stems 42 which are in turn parallel to the main cylinder axis 32.

A rocker arm 79 of L shape, has one end pivoted to a shaft 80 secured to the engine block 10 and parallel to crank shaft 22, while the other end of its main leg carries a cam follower roller 82 which rides at the periphery of a cam 84. The short leg of rocker arm 78 carries a roller 86 engaging the top end of piston rod 62.

Cam 84 which has holes 85 for weight reduction, is rotated by a cam shaft 88 through a synchronizing drive, for instance a chain and sprocket arrangement indicated at 90 in FIG. 3, by the crank shaft 22. Here again the cam 84 is rotated at half the speed of the crank shaft 22. The cam 84 rotates in the same direction as the crank shaft 22 as indicated by arrow 92. Cam shaft 88 is journalled in engine block 10 and is parallel to crank shaft 22.

When cam follower 82 rides on the smaller diameter circular portion 96 of cam 84, the secondary piston 58 is biased by spring 70 to its fully retracted position as in FIG. 1. When cam follower 82 rides on the larger diameter portion 98 of cam 84, the secondary piston 58 has moved to its advanced position, shown in FIG. 2, in which it is substantially flush with face 100 of cylinder head 16.

This face 100 defines the end face of working chamber 52. Smaller diameter portion 96 extends for about 180° while larger diameter portion 98 extends through about 156°, the two portions 96,98 being interconnected by two gradual steps 102, 103 each extending through about 12°.

Step 102 causes advancing movement of secondary piston 58 to a limit advanced position flush with working chamber end face 100 when power piston 18 moves away from its upper dead center position during its power stroke.

Step 103 allows retracting movement of secondary piston 58 when the power piston 18 commences its compression stroke.

The engine shown is a four cycle engine with an ignition device such as a spark plug 104 schematically shown at 104 in FIG. 4.

Figure 5:
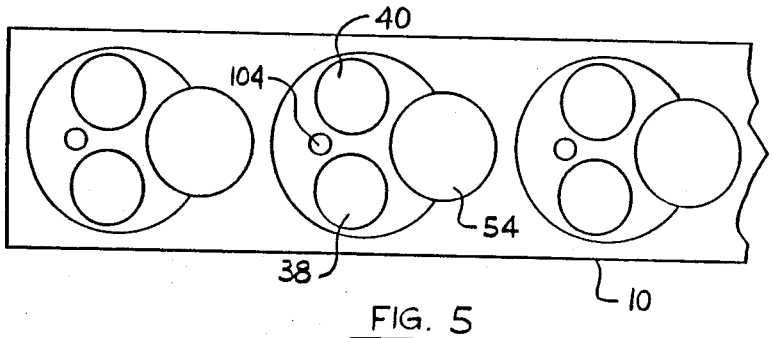
Figure 6:
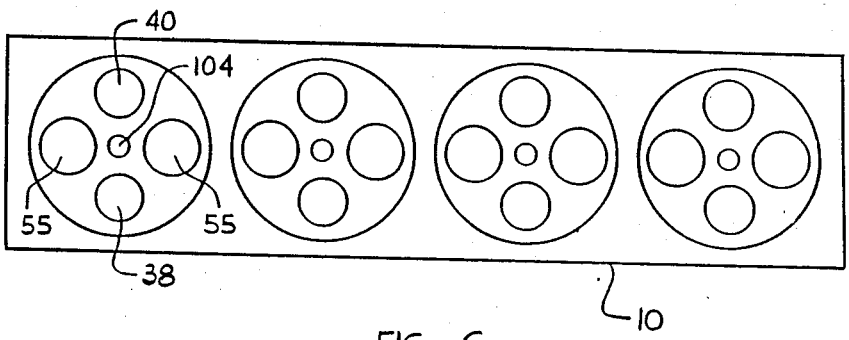

FIGS. 4, 5, 6 show a four cylinder engine arranged in line and, obviously, the operation of the valves and secondary piston is synchronized with its associated power piston. Different arrangements of the valves and secondary piston can be provided. The lateral projection 58 instead of extending laterally of the cylinder block 10 as shown in FIG. 4, can extend longitudinally of the same as shown in FIG. 5.

However, as shown in FIG. 6, the single cylinder extension 54 can be replaced by two such cylinder extensions 55, each made of half the diameter or cylinder extension 54 so that the valve and cylinder extension arrangements are all within the confines of the cylinder jacket 11 as shown in FIG. 6.

Referring to FIG. 5, valves 38,40 could be centered for maximum size since cylinder extension 54 can be offset still more. The volumetric displacement of the secondary piston 58 is preferably calculated in such a way as to keep the maximal compression pressure of the combustible mixture substantially constant within the working chamber 52 until the crank shaft 22 has rotated through an angle of about 30° from its position in which the line 106 intersecting the crank shaft axis 36 and the wrist pin axis is parallel to the cylinder axis 32. At this point or a few degrees before this, spark plug 104 will be operated in usual manner to ignite the combustible mixture. Therefore explosion takes place under maximum compression at the point where the crank shaft has rotated through 24° and to which must be added the 6° offset location of the crank shaft for a total of 30° as shown in FIG. 2. Also, when explosion takes place, the longitudinal axis of connecting rod 24 substantially coincides with the axis of power cylinder 14. Therefore the effective crank arm torque exerted on the crank shaft is equal to sinus 30° or 0.5. Due to this arrangement the effective pressure working on the power piston during the power stroke is considerably increased in relation to the increasing torque arm. It has therefore been calculated that the engine of the invention will be at least twice as powerful as a conventional engine of the same compression ratio and same volumetric displacement. Inversely, at equal power output, the engine of the invention will be half the size of a conventional engine, should consume half the fuel and therefore should polute half as much, and will have a much lower weight. It will have less parts, for instance, a two cylinder engine of the invention could replace a four cylinder conventional engine.

The engine principle of the invention can be applied to a 2 cycle as well as a 4 cycle engine or to a Diesel engine.

If the engine is equipped with a turbo charger, three times the power output of a conventional engine could be expected.

Because the time during which the combustible air fuel mixture is kept within the working chamber, is increased as represented by an additional 24° rotation of the crank shaft, a much more homogeneous mixture is obtained resulting in a maximum combustion efficiency, apart from the available increased torque.

The modified cylinder head should not have any heat problem. The normal leakage to be expected around the secondary piston will be so small as not to affect the compression ratio. Slight modification in the timing of the opening and closing movements of the intake and exhaust valves should be necessary in synchronism with the displacement of the secondary piston.

What I claim is:

1. An internal combustion engine comprising: an engine block defining a cylinder, a cylinder head closing one end of said cylinder, a power piston in said cylinder, a crank shaft journalled in said engine block at the other end of said cylinder, a connecting rod pivotally connecting said power piston and said crank shaft, said power piston reciprocable in said cylinder between upper and lower dead center positions, the cylinder space between said power piston and said cylinder head defining a working chamber for receiving a combustible mixture to be ignited by ignition means, intake and exhaust valves in said cylinder head, the axis of said crank shaft being laterally offset from the longitudinal axis of said cylinder, so that the connecting rod longitudinal axis makes an angle with the cylinder longitudinal axis when said connecting axis intersects the crank shaft axis, said angle in a direction to increase a resulting torque arm between the power piston and the crank shaft axes during each power stroke of said power piston, and said connecting rod longitudinal axis substantially coinciding with the longitudinal axis of said cylinder when ignition of said combustible mixture occurs, a secondary cylinder made in said cylinder head having a diameter at the most equal to 0.4 that of said cylinder and fully communicating with said working chamber, a secondary piston reciprocable within said secondary cylinder between a fixed retracted position and a fixed advanced position closer to said working chamber, and reciprocating means effective to move said secondary piston from said retracted to said advanced position at a start of each power stroke of said power piston and prior to ignition, and from advanced to retracted position at a beginning of each intake stroke of said power piston wherein the advanced position is maintained at least through the power stroke, and the retracted position is maintained at least through the intake stroke.

2. An internal combustion engine as defined in claim 1 wherein said angle is about 6°.

3. An internal combustion engine as defined in claim 2 wherein, during each power stroke of said power piston, said crack shaft rotates through about 24° from the upper dead center position of said power piston during a time period of when said secondary piston advances from its retracted to its advanced position, resulting in a torque arem equal to about sinus 30°.

4. An internal combustion engine as defined in claim 1, wherein said secondary piston has a secondary piston rod extending away from said cylinder, said reciprocating means including biasing means acting on said secondary piston rod to bias said secondary piston to said retracted position, a rocker arm having a free end provided with a cam follower and with a roller engaging a free end of said secondary piston rod, an outer end of said rocker arm rotatably mounted about a fixed axis relative to said engine block, which is parallel to the axis of said crank shaft, a cam rotatably about a fixed axis relative to said engine block, parallel to the axis of said crank shaft and generally aligned with said secondary piston rod, said cam driven in synchronism with the power piston and acting on said cam follower, said cam and biasing means maintaining said secondary piston in said retracted position during each compression stroke of said power piston, said cam advancing said secondary piston against bias of said spring means at a rate to maintain substantially uniform maximum gas pressure in said working chamber during each preignition phase of the power stroke of said power piston, and positively maintaining said secondary piston in said advanced position during ignition and throughout at least the power stroke.

5. An internal combustion engine as defined in claim 4, wherein said cylinder head defines a surface exposed within said cylinder and opposite said power piston, said secondary piston being substantially flush with said cylinder head surface in its advanced position.

6. An internal combustion engine as defined in claim 5, wherein said secondary cylinder has a diameter between 0.4 and 0.25 the diameter of said cylinder.

7. An internal combustion engine as defined in claim 6 and being of a four-cycle type, wherein said cam defines two opposite circular portions of different diameters, having a common center coinciding with the rotational axis of said cam, the smaller diameter portion extending through about 180°, the larger diameter circular portion extending through about 156°, two gradual steps interconnecting adjacent ends of arcs formed by respective ones of said circular portions and each extending through about 12°, said cam follower arranged to ride on the step advancing said secondary piston from said retracted to its advanced position immediately upon said power piston starting to move away from its upper dead center position during the power stroke, and drive means interconnecting said crank shaft and the cam to rotate said cam in synchronism with said crank shaft and at a speed half that of the latter.

* * * * *